United States Patent [19]

Lowry

[11] Patent Number: 4,618,029

[45] Date of Patent: Oct. 21, 1986

[54] ADJUSTABLE APPARATUS AND METHOD FOR ASSISTING IN MOTOR VEHICLE ENGINE REPAIR

[76] Inventor: Ron Lowry, 935 E. Vermont Ave., Phoenix, Ariz. 85016

[21] Appl. No.: 740,757

[22] Filed: Jun. 3, 1985

[51] Int. Cl.[4] ..... B25H 5/00

[52] U.S. Cl. ..... 182/116; 182/127

[58] Field of Search ..... 182/116, 127, 17, 63, 182/129

[56] References Cited

U.S. PATENT DOCUMENTS

| | | | |
|---|---|---|---|
| 640,354 | 1/1900 | Bailey | 182/116 |
| 2,624,590 | 1/1953 | Tilton | 182/17 |
| 2,701,168 | 2/1955 | Schemers | 182/116 |
| 2,872,252 | 2/1959 | Konkle | 182/131 |
| 2,969,123 | 1/1961 | Jamerson | 182/17 |
| 2,970,668 | 2/1961 | Snyder | 182/116 |
| 3,976,155 | 8/1976 | Esch | 182/116 |
| 4,072,209 | 2/1978 | Bolis | 182/116 |
| 4,397,374 | 8/1983 | Rumage | 182/129 |
| 4,530,419 | 7/1985 | Rumage | 182/116 |

*Primary Examiner*—Reinaldo P. Machado

*Attorney, Agent, or Firm*—Harry M. Weiss & Associates

[57] ABSTRACT

An adjustable apparatus and method for aiding a mechanic or repairman in his task to repair a motor vehicle engine is disclosed. This invention has a lower support means having a plurality of wheels therebelow; an intermediate support means for adjusting vertical position; and an upper support means removably attached to the intermediate support means and generally parallel to the lower support means for supporting the mechanic in conveniently and efficiently performing his tasks proximately above the engine. The invention further has at least a pair of removable angularly extending member means having a plurality of struts attached therebetween for allowing the repairman to ascend onto the upper support means and pad means removably mounted on a mechanic support rested on a generally u-shaped brace member of the upper support means. For further stability and support, the lower support means may have at least a pair of elongated members having end portions outwardly flared.

12 Claims, 5 Drawing Figures

ADJUSTABLE APPARATUS AND METHOD FOR ASSISTING IN MOTOR VEHICLE ENGINE REPAIR

BACKGROUND OF THE INVENTION

1. Field of the Invention

This invention generally relates to an adjustable apparatus and a method for assisting in the repair of motor vehicle engines. The apparatus and method of the present invention serves a user by providing him with a fully functional and sturdy means to position himself over the motor vehicle engine in order to make the task as comfortable or efficient as possible. Moreover, the apparatus and method of the present invention accommodates a user of any size, weight, or form and capable of providing a convenient means by which the user is reasonably able to reach practically any part of the motor vehicle.

2. Description of the Relevant Art

During the performance of any repair task on a motor vehicle engine, a repairman must frequently lean over the engine by resting part of his upper body on the side of front of the motor vehicle for support. After a prolonged period of time, maintaining a leaning position over the engine can be very cumbersome and strenuous. Not only are the back muscles severely stretched due to maintaining the extended, leaning position for prolonged period of time, the arm, neck and upper leg muscles are strained as well.

Although leaning over the body of the motor vehicle adjacent of the engine may partially alleviate the muscle strains, the mechanic leaning over a motor vehicle painted surface increases the undesirable chances of it being scratched or marred. Even if the mechanic is able to lean over the engine itself, the greasy surfaces, sharp protrusions and hot metallic parts of the engine would make leaning over it, or any part of it, an undesirable alternative. Cushions and mats have been provided for in order to reduce the above-mentioned problems to be used as a protective means between the repairman and the motor vehicle body surface or engine. However, a cushion or a mat tends to move or slide away thereby creating further inconvenience in the attempts to frequently re-position the cushion or mat to the satisfaction of the mechanic.

Moreover, because of the multiplicity of intricate parts that make up a motor vehicle, it is necessary to provide the mechanic with the fullest comfort to enable him to sustain his full concentration in repairing or working with said parts. Thus, it is essential for the repairman to be void of bodily discomforts caused by leaning on either the motor vehicle's body or engine. Additionally, a means to permit the mechanic to conveniently have immediate access to a substantial portion of the vehicle engine especially at the center and lower portions, is essential.

In order to provide comfort to the mechanic, the easy access to the various parts of the engine, and the prevention of damage to the vehicle's body surface, it is known in the related art, as disclosed in U.S. Pat. No. 4,397,374 by Rumage, et. al. to provide a support including a platform to stand on and also a platform for the mechanic to lie on integrally connected to a T-shaped mobile frame and rectangular tube members supported thereon. Here, however, no means for allowing the mechanic to mount on when it is necessary for him to gradually increase his working elevation.

In U.S. Pat. No. 2,872,252 by Konkle, (issued Feb. 3, 1959) an adjustable platform is provided for a repairman to allow him to stand on when the service stand is placed adjacent to the motor vehicle. Here, however, it is clearly inconvenient and time consuming to frequently readjust the horizontal platform to achieve the desired working elevation. Moreover, the Konkle apparatus clearly does not permit the entire mechanic's body to be supported thereon due to its structural deficiencies in providing the upper support to accommodate the repairman's body and the lower support to stabilize the device for compensating for his weight. In both U.S. Pat. Nos. 2,970,668 by Snyder (issued Oct. 25, 1956) and 4,072,209 by Bolis (issued Feb. 7, 1978), a mechanic's scaffold or repair apparatus are disclosed. However, both these apparatus provide an angularly extended frame originating from a tubular base thereby clearly disadvantageously limiting the reach of the mechanic when the upper portion of the frame impinges upon the body of the vehicle while the apparatus is moved adjacent to said vehicle. Similarly, both U.S. Pat. Nos. 2,701,168 by Schemers (issued Feb. 1, 1955) and 2,969,123 by Jamerson, et. al. (issued Jan. 24, 1961) disclose the angularly extending frame described by Snyder and Bolis. Moreover, both the Schemers and Jamerson, et. al. devices clearly do not provide the proper support means to sustain or stabilize, for an extended period of time, the entire body weight of the mechanic or repairman.

A need was therefore felt to assist a mechanic or repairman by providing an adjustable apparatus and method for assisting in motor vehicle engine repair of a motor vehicle of any size, shape of form.

It is therefore an object of the present invention to provide an improved adjustable apparatus and method for preventing or alleviating muscle stress and strain or a mechanic's back, arms, neck, leg or the like when required to reach out to repair a motor vehicle engine, in whole or in part.

It is another object of the present invention to provide an improved adjustable apparatus and method during repair of the motor vehicle engine for preventing a mechanic for leaning over any part of the body of a motor vehicle which tends to scratch or marr the painted surface of the vehicle.

It is another object of the present invention to provide an improved adjustable apparatus and method during repair of the motor vehicle engine for preventing a mechanic from leaning over any part of said engine which is highly undesirable when the engine has greasy surfaces, sharp protrusions or hot metallic parts.

It is yet another object of the present invention to provide an improved adjustable apparatus and method during repair of the engine capable of being easily placed and sturdily positioned at a proximate distance adjacent to any side abutting the engine to permit the mechanic to have complete access to any part of the engine without performing any unnecessary strenuous positions.

It is a further object of the present invention to provide an improved adjustable apparatus and method during repair of the engine which can be easily disassembled, due to its construction, into a few number of parts and stored when not in use.

It is a further object of the present invention to provide an improved apparatus and method during repair of the engine which can be easily and economically produced, yet sturdy in construction and highly efficient in operation.

It is a further object of the present invention to provide an improved apparatus and method during repair of the engine which is constructed with extreme simplicity, embodying simple removable parts, and therefore capable of being retailed for a low price, long-lasting in use, and convenient to handle.

It is a more particular object of the present invention to provide at least a pair of vertical support members adjustably joined thereto, and at least a pair of angularly extending members having a plurality of horizontal struts connected thereto removably attached to a wheeled base to permit an upper support means for removably accommodating and sturdily mounting a horizontal body support means to in turn accommodate a repairman.

SUMMARY OF THE INVENTION

The aforementioned and other objects of the present invention are accomplished by providing an improved adjustable apparatus and method during the repair of a motor vehicle engine comprising a base of elongated members having a plurality of wheel means and capable of supporting a removably attached adjustable vertical member and angularly positioned members having a plurality of horizontal struts connected thereto. The end portions of the elongated members of the base may be outwardly flared out to provide further stability and support. The lower ends of the adjustable vertical members and angularly positioned members are removably attached to the base. The upper end of the angularly positioned members are removably connected to an intermediate horizontal strut permanently attached to the adjustable vertical members. Moreover, the upper portion of the adjustable vertical members have an upper support means removably attached thereto to permit horizontal members to be removably attached to an upper strut of the vertical members in order to comfortably accommodate and sturdily support a mechanic during his work in repairing the motor vehicle engine.

These and other features of this invention will be understood upon reading of the following description along with the drawings.

DESCRIPTION OF THE PREFERRED EMBODIMENT

Figures 1, 2, 3, 4, 5:
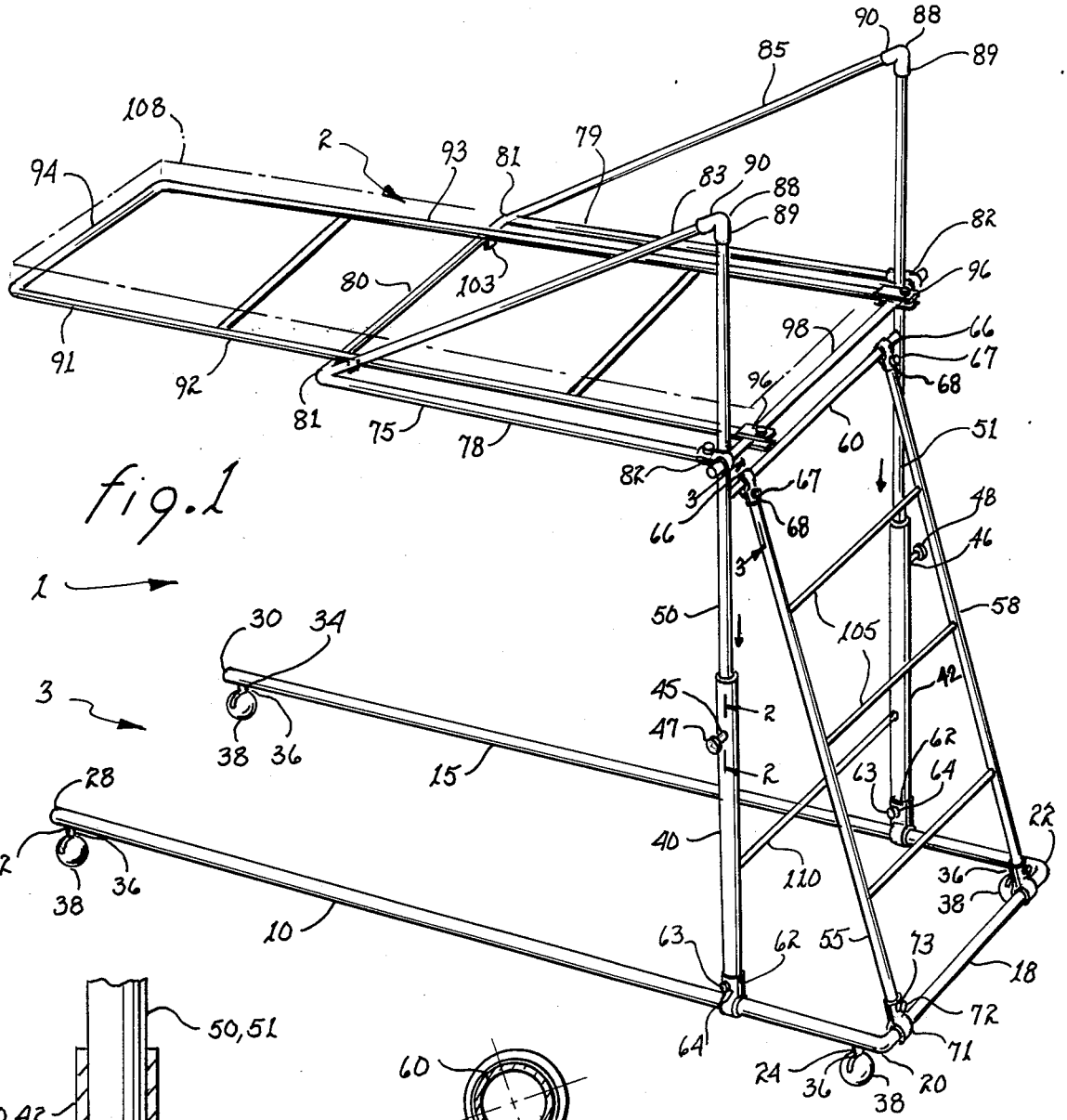
FIG. 1 is a perspective view of one embodiment of an adjustable apparatus in accordance with the present invention showing the upper support ready for accommodating a repairman.
FIG. 2 is a cross-sectional view of an elongated member taken in the direction of arrows 2—2 in FIG. 1 illustrating how a pin passes through apertures in the elongated member and permit the seating of the lower end of an elongated member having a rubber-like pad attached thereto.
FIG. 3 is a cross-sectional view of one horizontal strut member taken in the direction of arrows 3—3 shown in FIG. 1 illustrating how a rigid strap-like member attached to an associated angularly extending member may be removably attached to horizontal strut member.
FIG. 4 is a cross-sectional view of one of the struts attached to the vertical support members taken in the direction of arrows 4—4 shown in FIG. 1 illustrating how at least a pair of horizontally extending brackets attached to an associated horizontal support member may be removably attached to the strut.
FIG. 5 is a cross-sectional view of the front elongated member of the upper support member taken in the direction of arrows 5—5 shown in FIG. 1 illustrating how one of the downwardly protruding brackets attached to an associated mechanic support member may be located behind the front elongated member for further support of the mechanic's weight when the apparatus of the present invention is in use.

FIG. 1 is a perspective view of one embodiment of an adjustable apparatus, generally designated by reference number 1, showing an upper support, generally designated by reference 2, generally located in parallel over a lower support, generally designated by reference number 3, ready for use. The lower support 3 has at least a pair of elongated members 10, 15 preferably parallel to each other and perpendicular to an extended member 18. When the apparatus 1 is in use, the upper support 2 rests proximately above the motor vehicle engine while the lower support lies underneath the vehicle just beneath the engine. The elongated members 10, 15 and extended member 18 are preferably made of steel and preferably solid. Alternatively, the elongated members 10, 15 and extended member 18 may also be made of other types of durable or rigid materials, such as plastic or the like. Each of the elongated members 10, 15 has a back end 20, 22 attached to each of the ends of extended member 18. The attachment is preferably by way of welding; although, straps or bolts (not shown) may alternatively be used, if desired. The end portions of the elongated members 10, 15 may be outwardly flared to provide further stability and support.

As further shown in FIG. 1, each of the lower portions 24, 26, 32, 34 proximate to each of the ends 20, 22, 28, 30, respectively, of the elongated members 10, 15 has a conventional bracket 36 and wheel 38 combination to permit the adjustable apparatus 1 to be mobile when in use.

Each of the elongated members 10, 15, has a vertical support member 40, 42 removably attached thereto and generally extending perpendicular therefrom. Each vertical support member has an aperture 45, 46 passing therethrough to accommodate a bolt 47, 48 therein. Each bolt 47, 48 is preferably made of sturdy material so that when installed through apertures 45, 46, each bolt 47, 48 is able to accommodate a vertically elongated member 50, 51 and preferably above to withstand the lateral weights (shown by downwardly arrows) of the upper support 2 and a repairman.

As shown in FIG. 2, the lower end of each vertically elongated member 50, 51 rests on a pad 53 preferably permanently attached thereto for resting on the bolt 47, 48. The pad is preferably made of hard rubber, soft plastic, or any other suitable material that is durable and long lasting. Each of the vertical support member 40, 42 is removably attached to and preferably extend perpendicularly from the elongated members 10, 15. The removable attachment means similarly comprises a structural embodiment illustrated in FIG. 3 for an angularly extending member 55, 58 removably attached to extended member 18 and horizontal strut 60 as will later be discussed in more detail. A strap 62 is removably attached to the lower end of vertical support member 40, 42 by a bolt and nut combination 63 accommodated by aperture 64 at the lower end of vertical support member 40, 42 and the strap 62 end portions passing therethrough. The strap 62 may be a two-piece C-type clamping strap or a one-piece strap (as similarly illustrated in FIG. 3). The strap 62 is preferably made of a rigid, sturdy and long-lasting material, such as steel.

As specifically and appropriately shown in FIG. 3, the upper portion of the angularly extending member 55, 58 is removably joined to horizontal strap 60 by a bolt and nut combination 67 accommodated by aperture 68 at the upper portion of the angularly extending member 55, 58 and strap 66 end portions passing therethrough. Similarly, the lower portion of the angularly extending member 55, 58 is removably joined to the extended member 18 by a bolt and nut combination 72 accommodated by aperture 73 at the lower portion of the angularly extending member 55, 58 and strap 71 end portion passing therethrough. The straps 66, 71 may also be a two-piece C-type clamping strap or a one-piece strap, as illustrated in FIG. 3. The straps 66, 71 are preferably made of rigid, sturdy and long-lasting material, such as steel.

The intermediate portion of the vertically elongated member 55, 51 has a generally U-shaped brace member 75 attached thereto by a similar type of strap attaching means, generally referred to by numeral 82, structurally embodying the previously discussed embodied strap 62, 66, 71 and bolt 63, 67, 72 type combination and preferably located parallel to at least the pair of elongated members 10, 15. The u-shaped brace member 75 has at least a pair of extending members 78, 79 and a base member 80. The ends 81 of the extending members 78, 79 has longitudinal members 83, 85 angularly extending therefrom and joining to the upper ends of elongated members 50, 51 by tubular coupling 88 having a downwardly extending member 89 and angularly extending member 90, as shown in FIG. 1. The angularly extending member 90 is preferably permanently joined to longitudinal member 83, 85 while the downwardly extending member 89 is preferably removably mounted on the upper ends of elongated member 50, 51.

A mechanic support member 91, also generally having a u-shaped member having a first 92, second 93 and third 94 side member is removably joined as shown in FIG. 4 to an upper strut 98 attached to the vertically elongated members 50, 51 as illustrated in FIG. 1. As shown in FIG. 4, the first 92 and second 93 sides of the mechanic support member 91 has a lower 95 and an upper 96 brackets integrally connected thereto and protruding outwardly toward the surface of the upper strut 98. The lower 95 and upper 96 brackets have apertures 99, 100 passing therethrough to accommodate a bolt-nut 100 combination for removably and sturdily joining the mechanic support member 91 to the upper strut 98.

As illustrated in FIG. 5, the first 92 and second 93 sides of the mechanic support member 91 has a guide tab 103 attached thereto and downwardly protruding therefrom to permit the guide tab 103 to be impinged onto the base member 80 of the u-shaped brace member 75 to stabilize the upper support 2 when in use.

To permit a mechanic or a repairman to ascend onto the mechanic support member 91, a plurality of struts 105 are attached to the angularly extending member 55, 58. Upon ascending the plurality of struts 105, the mechanic forwardly bends toward the support member 91 and comfortably rests in a prone position upon a pad 108 ready to repair the engine of the motor vehicle while the u-shaped brace member 75 and mechanic support member 92 rest proximately thereabove while the elongated members 10, 15 lie underneath the vehicle just beneath the engine. A plurality of horizontal strut members 110 may be attached to vertical support 40, 42 and elongated 50, 51 members for further stability and rigidity for the apparatus 1.

When not in use, the elongated members 10, 15 having the extended member 18; the vertical support members 40, 42 having the plurality of horizontal strut members 110; the elongated members 50, 51 having the horizontal strut 60, upper strut 98 and plurality of horizontal strut members 110; the extending members 78, 79 with the base member 80 and longitudinal members 83, 85; the mechanic support member 91; and other parts, singly or in combination, may be disassembled from each other to compactly store and conveniently transport the apparatus 1, as needed.

The above description is included to illustrate the operation of the preferred embodiments and is not meant to limit the scope of the invention. The scope of the invention is to be limited only by the following claims. From the above discussion, many variations are apparent to one skilled in the art which would yet be encompassed by the spirit and scope of this invention.

I claim:

1. An adjustable apparatus for aiding a motor vehicle engine repairman, comprising:

a lower support means for supporting said apparatus having a plurality of wheel means therebelow for allowing said lower support means to be easily moved underneath said motor vehicle;

an intermediate support means removably attached to said lower support means for adjusting said apparatus vertical position;

an upper support means removably attached to said intermediate support means and generally parallel to said lower support means for supporting said repairman in repairing said engine of said vehicle, said upper support generally comprising a u-shaped brace member and a mechanic support member removably attached to said intermediate support means;

at least a pair of angularly extending member means having a plurality of struts attached therebetween for allowing said repairman to ascent onto said upper support means, said angularly extending member means suitable for removably attaching to said lower and intermediate support means; and a pad means removably mounted on said mechanic support member.

2. The adjustable apparatus of claim 1, wherein said lower support means comprises at least a pair of elongated members and an extended member, each end of said extended member integrally connected perpendicularly to each end of said elongated member.

3. The adjustable apparatus of claim 2, wherein said intermediate support means comprises at least a pair of vertical support members and at least a pair of elongated support members, each of said elongated support member fitting into each of said support member.

4. The adjustable apparatus of claim 3, wherein the lower end of each vertical support member is integrally attached to a strap-like rigid member to permit each of said strap-like member to be wrapped around each of said elongated member of said lower support means to permit removable coupling of the lower end of said intermediate support means to said lower support means.

5. The adjustable apparatus of claim 4, wherein each of said vertical support member has an aperture passing therethrough to permit a bolt to be accommodated therein.

6. The adjustable apparatus of claim 5, wherein the lower end of each elongated member has a pad integrally attached thereto, the material of said pad is selected from the group consisting of rubber and plastic.

7. The adjustable apparatus of claim 6 wherein said u-shaped brace member has at least a pair of longitudinal members angularly extending therefrom and joining to the upper ends of said elongated members of said intermediate support means, each end of said u-shaped brace member is integrally attached to a strap-like rigid member to permit each of said strap like members to be wrapped around each of said vertical elongated member of said intermediate support means to permit removable coupling of said u-shaped brace member to said intermediate support means.

8. The adjustable apparatus of claim 7, wherein said mechanic support member is removably attached to an upper strut integrally connected to said intermediate support means, each end of said mechanic support member has at least a pair of bracket members each having an aperture passing therethrough to accommodate a bolt therein for removably connecting said mechanic support member to said upper strut.

9. The adjustable apparatus of claim 8, wherein each of said longitudinal member angularly extending from said u-shaped brace member and said upper ends of said elongated member of said intermediate support means has a coupling member attached therebetween, said coupling member has a downwardly extending member integrally connected to said longitudinal member of said u-shaped brace member and an angularly extending member removably connected to said upper ends of said elongated member of said intermediate support means.

10. The adjustable apparatus of claim 9, wherein the upper and lower ends of said angularly extending member means has integrally attached thereto a strap-like rigid member to permit each of said strap-like member to be wrapped around to a horizontal strut of said intermediate support means and an extended member of said lower support means, respectively.

11. The adjustable apparatus of claim 2, wherein the end portions of each of said elongated member of said lower support means are outwardly flared to provide further stability and support.

12. The adjustable apparatus of claim 11, wherein each end portion of each of said elongated member of said lower support means flared outwardly at 18° away from a middle straight portion of each of said elongated member.

* * * * *